US005208943A

United States Patent [19]

Dubach et al.

[11] Patent Number: 5,208,943

[45] Date of Patent: May 11, 1993

[54] HINGE WITH A COUPLING MEMBER RELEASABLY ANCHORED

[75] Inventors: Fredi Dubach, Adetswil, Switzerland; Erich Röck, Höchst, Austria

[73] Assignee: Julius Blum Gesellschaft m.b.H., Höchst, Austria

[21] Appl. No.: 884,290

[22] Filed: May 13, 1992

Related U.S. Application Data

[63] Continuation of Ser. No. 675,524, Mar. 26, 1991, abandoned.

[30] Foreign Application Priority Data

Mar. 27, 1990 [AT] Austria ..... 705/90

[51] Int. Cl.[5] ..... E05D 5/00

[52] U.S. Cl. ..... 16/258; 16/382; 16/272; 16/270

[58] Field of Search ..... 16/258, 257, 382, DIG. 43, 16/270, 271, 272, 261, 268, 259

[56] References Cited

U.S. PATENT DOCUMENTS

| | | | |
|---|---|---|---|
| 1,070,754 | 8/1913 | Vollman | 16/272 |
| 4,091,500 | 5/1978 | Lautenschlager | 16/383 |
| 4,376,324 | 3/1983 | Lautenschlager et al. | 16/382 |
| 4,760,623 | 8/1988 | Toyama | 16/258 |
| 4,823,436 | 4/1989 | Salice | 16/258 |
| 4,839,940 | 6/1989 | Grass | 16/DIG. 43 |
| 4,850,080 | 7/1989 | Rock et al. | 16/258 |
| 4,937,917 | 4/1990 | Rock et al. | 16/245 |

FOREIGN PATENT DOCUMENTS

| | | | |
|---|---|---|---|
| 2736333 | 2/1979 | Fed. Rep. of Germany | 16/DIG. 43 |
| 8434085 | 5/1986 | Fed. Rep. of Germany . | |
| 2432077 | 2/1980 | France . | |
| 82283 | 5/1971 | German Democratic Rep. . | |
| 2028914 | 3/1980 | United Kingdom . | |
| 2050496 | 1/1981 | United Kingdom . | |

*Primary Examiner*—Lowell A. Larson
*Assistant Examiner*—Michael J. McKeon
*Attorney, Agent, or Firm*—Wenderoth, Lind & Ponack

[57] ABSTRACT

A hinge includes a hinge arm mountable on a wall of a furniture unit and at least one hinge pot mounted on a furniture door and rotatably connected to the hinge arm. The hinge pot has a recess into which an inner coupling member may be inserted and in which the latter is releasably anchorable by means of a locking member acted upon by a spring. Provided in one part of either the hinge pot or the coupling member is at least one shoulder which is received with form fit in a recess of the other part. The coupling member may be inserted into the hinge pot in a direction perpendicular or approximately perpendicular to the plane of the door. The locking member, which is mounted tiltably on the coupling member, presses against a nose of a hinge pot wall delimiting the recess.

17 Claims, 8 Drawing Sheets

HINGE WITH A COUPLING MEMBER RELEASABLY ANCHORED

This application is a continuation of now abandoned application, Ser. No. 07/675,524, filed Mar. 26, 1991.

BACKGROUND OF THE INVENTION

The invention relates to a hinge, in particular a single-axis or axle hinge, having a hinge arm mountable on a wall of a furniture unit, and at least one hinge pot connected to a door of the unit and rotatably connected to the hinge arm, the hinge pot having a recess or interior into which an inner coupling member may be inserted and in which the latter is releasably anchorable by means of a locking member acted on by a spring.

Such hinges are used in particular in the construction of office, organizational and functional furniture. They are used as corner and twin hinges, i.e. hinges to which two doors are joined. In general, they are made as single-axis hinges, but success is not to be restricted thereto.

In the case of conventional hinges, a baseplate is secured to a side wall of the furniture unit when the latter is assembled. A hinge pot is set in the door and is connected to the actual hinge arm via an articulated spindle or four articulated spindles and two articulated levers. In the final assembly, the hinge arm is placed on the baseplate, which is mounted on the side wall of the furniture unit, and is connected thereto. The position of the door can be adjusted by relative displacement of the position of the hinge arm with respect to the baseplate. In general, conventional hinges provide the possibility of adjustment in the direction of the width of the furniture door joint and the depth of the furniture unit. In some cases, height adjustment is also possible.

Hinges of the type mentioned at the outset differ from such conventional hinges in that the hinge arm is secured directly to the side wall of the furniture unit, for example is screwed thereto. This has the advantage that the hinge can be kept very narrow, and further space is saved by the omission of an additional baseplate. As a result, the entire width of the furniture unit may be used to the optimum, this being particularly useful, for example, with index card files or the like.

With such hinges, two-part assembly also is known, i.e. the hinge arm is secured to the side wall of the furniture unit and a hinge pot is set in the door. When the door is finally hung, the hinge pot is connected to the hinge arm via a coupling member jointed to the hinge arm. In the case of conventional hinges, this is done by means of a clamping screw.

SUMMARY OF THE INVENTION

It is the object of the invention to improve a hinge of the type mentioned at the outset such that hanging of the door, i.e. connection of the hinge pot to the coupling member, is facilitated. It should be possible for the hanging operation to be achieved without tools, since tightening of a clamping screw often poses difficulties if the door has to be held or supported. Similarly, in accordance with the invention it should be possible to remove the door easily, i.e. to separate the hinge pot from the hinge arm. It is a particular object of the invention to make possible coupling of the hinge pot and the coupling member in any position of the hinge.

The above objects according to the invention are achieved in that there is provided in one part including either the hinge pot or a coupling member at least one shoulder which is received with form fit in a groove or recess of the other part, the coupling member being insertable into the hinge pot in a direction perpendicular or approximately perpendicular to the plane of the door, and in that a locking member, which is mounted tiltably on the coupling member, bears against a nose of a hinge pot wall delimiting the recess.

Advantageously, the shoulder and the recess have diverging side faces. This simplifies insertion of the coupling member into the hinge pot. In order to be able to release the coupling member from the hinge pot easily, advantageously a lever is mounted rotatably in the hinge pot and may be used to press the locking member away from the nose.

BRIEF DESCRIPTION OF THE DRAWINGS

Embodiments of the invention are described below with reference to the attached drawings, wherein.

DETAILED DESCRIPTION OF THE INVENTION

Figure 1:
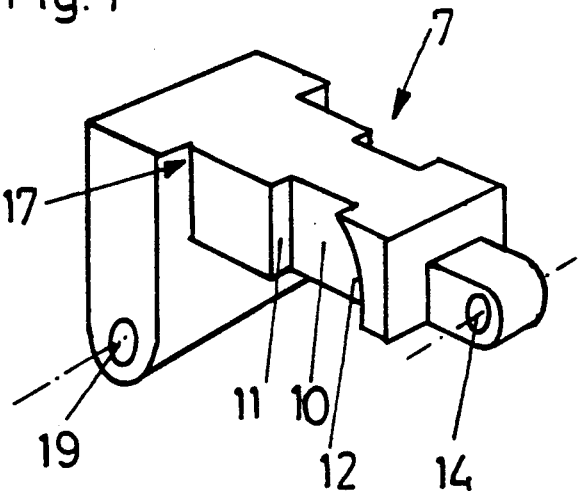
FIG. 1 is a perspective view of a coupling member.
Figure 3:
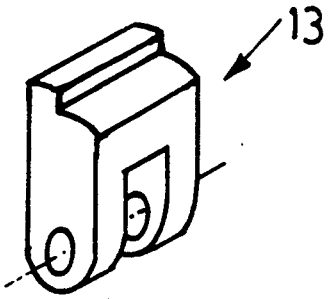
FIG. 3 is a perspective view of a locking member.
Figure 2:
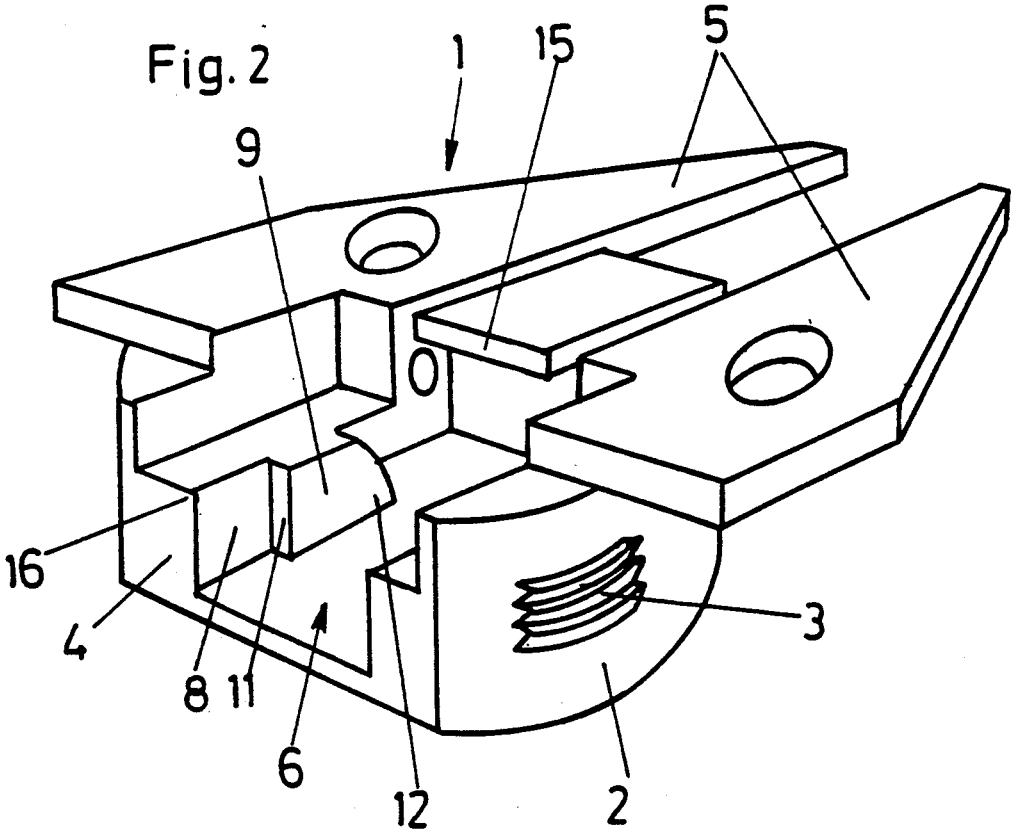
FIG. 2 is a perspective view of a hinge pot.
Figure 4:
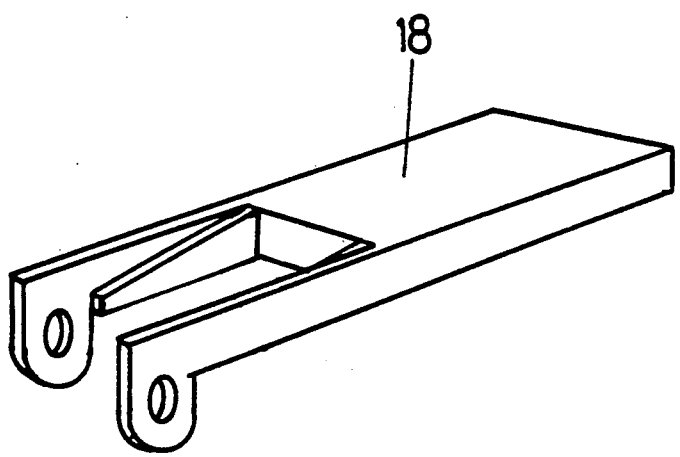
FIG. 4 is a perspective view of an unlocking lever.
Figure 10:
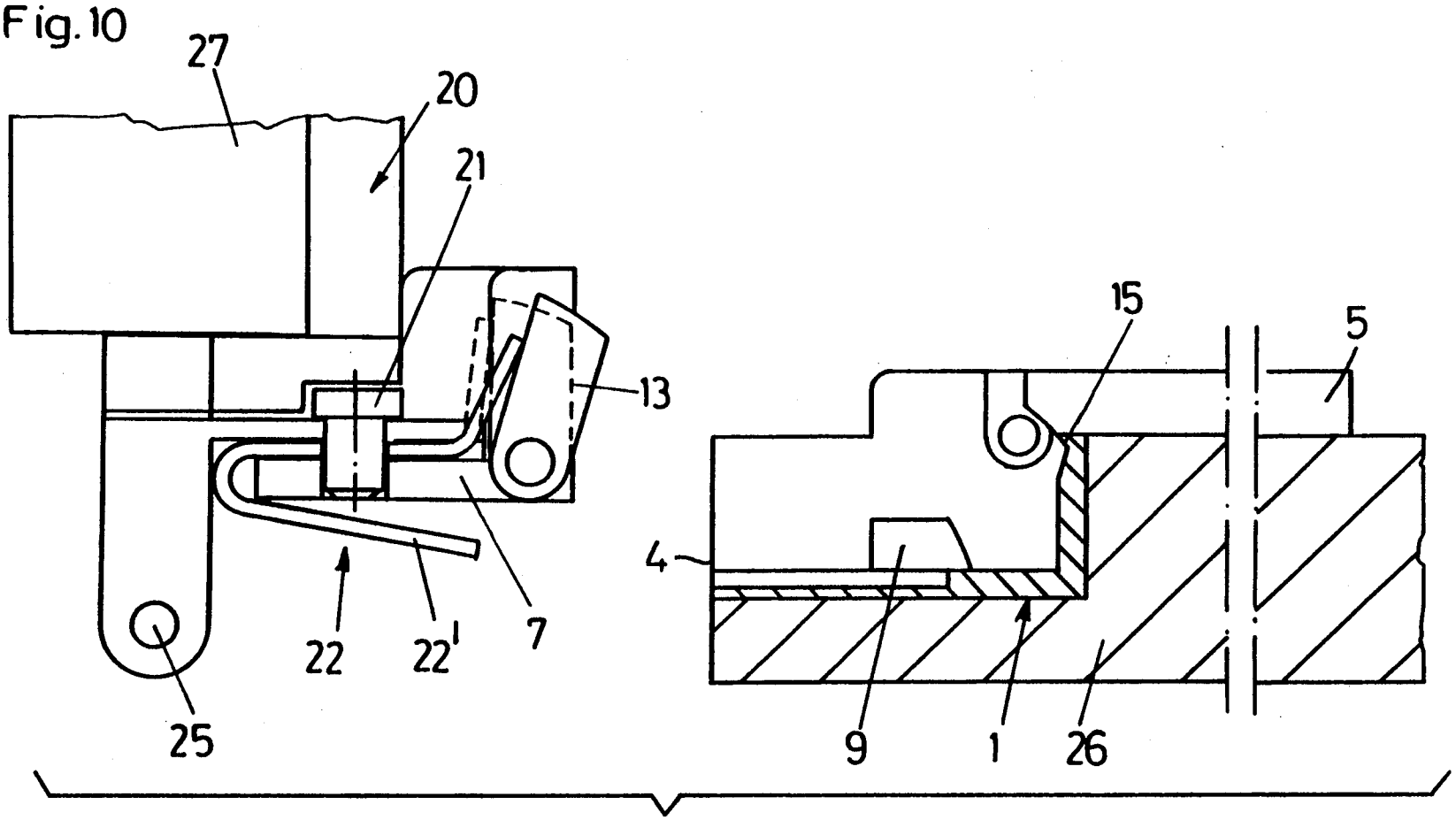
FIG. 10 is a partial section through the hinge arm with coupling member and through the hinge pot, the hinge pot on a door and the hinge arm on a furniture wall being shown separated.

A hinge pot 1 shown in FIG. 2 comprises a flattened cylinder 2 provided on the outside thereof with ribs 3 and cut away in a segment manner on one side so that it has a flat side 4 to be aligned with an end face of a furniture door 26 (see FIG. 10). The hinge pot 1 is provided with a flange 5 which bears against the furniture door 26.

The hinge pot 1 also has a recess 6 into which a coupling member 7 may be inserted and in which it may be anchored. On two side walls 8 of the recess 6 are shoulders 9 which project into corresponding grooves or recesses 10 of the coupling member 7. In the illustrated embodiment, the shoulders 9 and the recesses 10 each have a straight side wall 11 and a curved side wall 12, the side walls 11, 12 diverging towards the base of the hinge pot 1.

A locking member 13 is mounted tiltably about an axis 14 at a front end of the coupling member 7. If the coupling member 7 is inserted into the recess 6 of the hinge pot 1 in such a way that the recesses 10 receive the shoulders 9 snugly, the locking member 13, which is acted upon by a spring 22, latches behind a catch or nose 15 of the hinge pot 1 and thus locks the coupling member 7 in the hinge pot 1. In order to improve the retention of the coupling member 7 in the hinge pot 1, corresponding stops 16, 17 may be provided to prevent the coupling member 7 from being pressed away at a side facing a hinge arm 20. The stops 16 are on the flattened-off side 4 of the hinge pot 1, and the steps 17 are on corresponding flat sides of the coupling member 7.

Further mounted in the hinge pot 1 is an unlocking lever 18 which extends flush with the flange 5 and whose function will be explained later.

Figure 11:
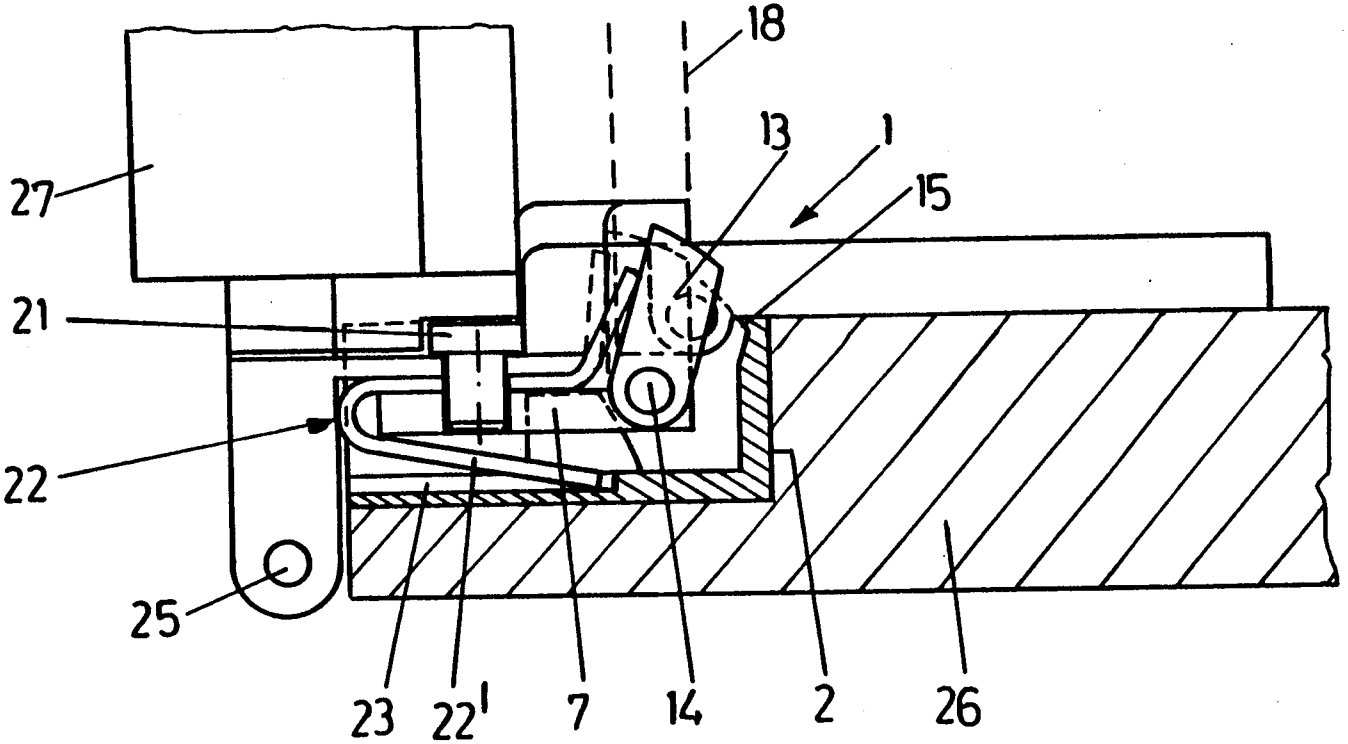
FIG. 11 is a similar view, but showing the hinge arm and the hinge pot in section during assembly.
Figure 12:
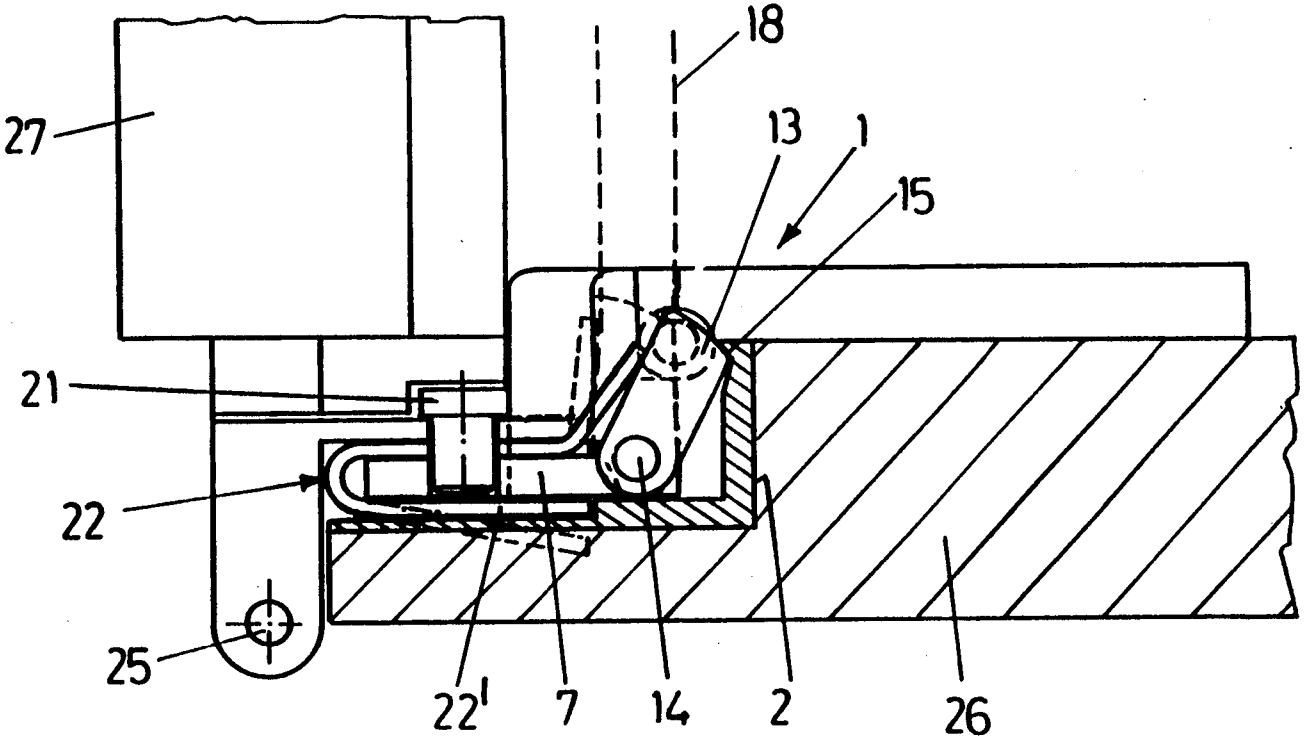
FIG. 12 is a view similar to FIG. 11, but with the coupling member being anchored in the hinge pot.
Figure 13:
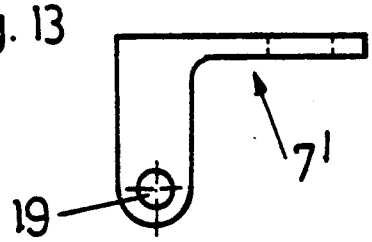
FIGS. 13 and 14 are side and plan views, respectively, of one part of a two-part coupling member.
Figure 14:
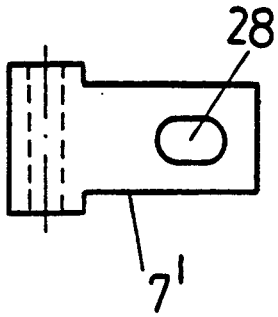
Figure 15A:
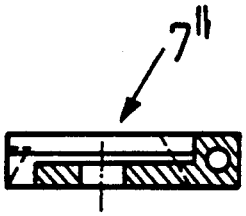
FIGS. 15*a*, 15*b* and 15*c* are respectively a section, a plan view and a side view of the other part of the two-part coupling member.
Figure 15B:
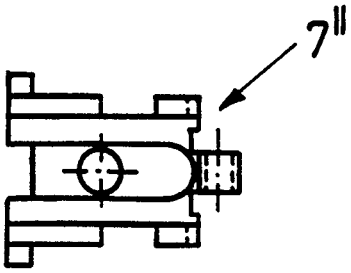
Figure 15C:
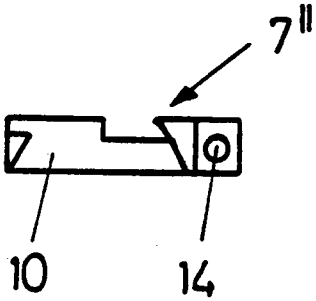

In order to enable the hinge to be adjusted in a depthwise direction, the coupling member 7 may be of two-part construction as shown in FIGS. 13–15c, namely comprising a part 7′ which defines a hinge axis 19 and a part 7″ in which the recesses 10 are formed and in which the axis 14 or a mounting eye forming the axis 14 for the locking member 13 is defined. The parts 7′, 7″ are held together in a clamping manner by a screw 21 as shown in FIGS. 10–12. To do this, the screw 21 projects through an elongate hole 28 in the part 7′. The length of the elongate hole 28 determines the extent of depthwise adjustment.

The leaf spring 22, which presses the locking member 13 against the bottom wall of the recess 6 and against the nose 15 of the hinge pot 1, is held in a clamping manner between the parts 7′, 7″, as can be seen from FIGS. 10–12. As can be seen from FIG. 11, a leg 22′ of the leaf spring 22 presses against the base of the hinge pot 1 and is received in a recess 23 defined therein.

Figure 5:
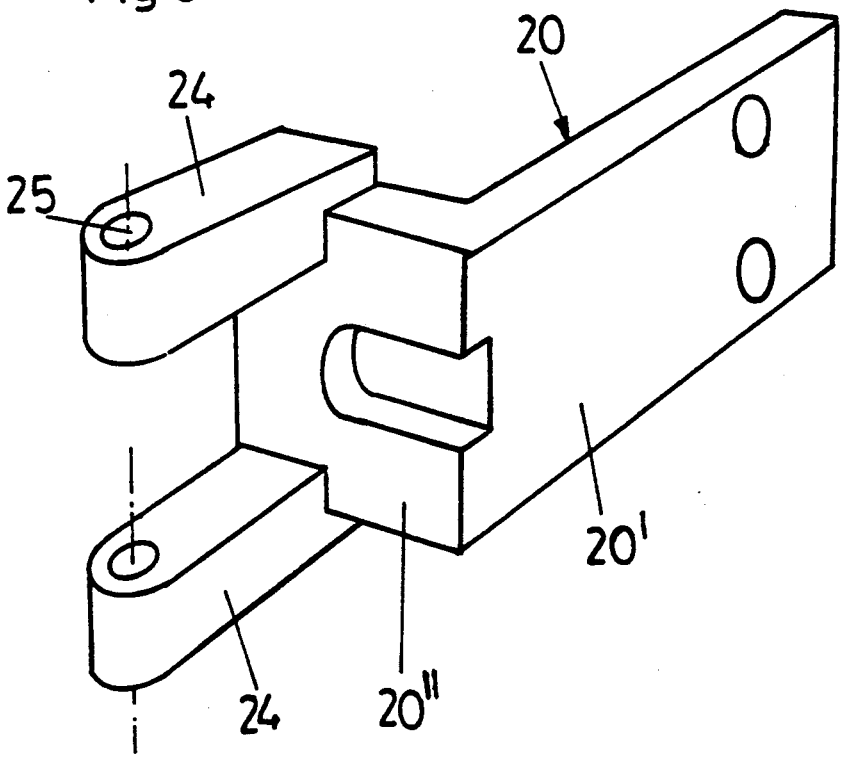
FIG. 5 is a perspective view of a hinge arm.
Figure 6:
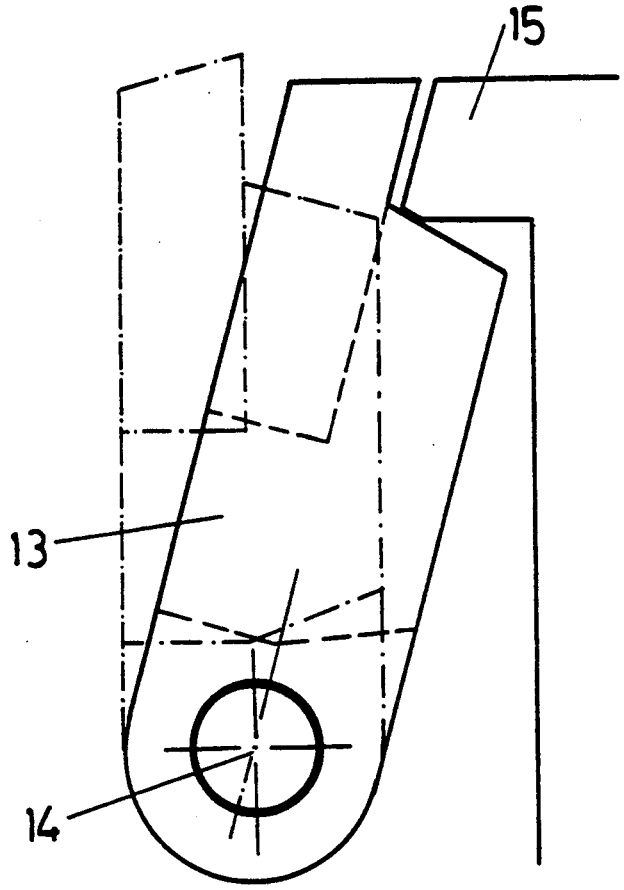
FIG. 6 is a side view of the locking member.
Figure 7:
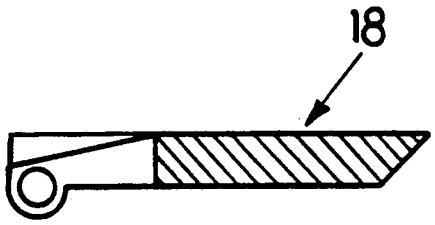
FIG. 7 is a longitudinal section through the unlocking lever in accordance with FIG. 4.
Figure 8:
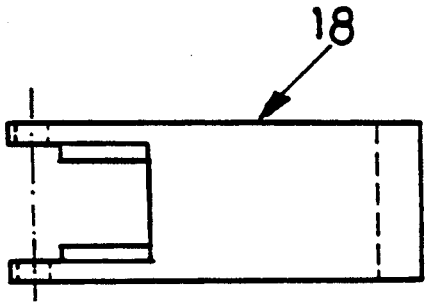
FIG. 8 is a plan view of the unlocking lever.
Figure 9:
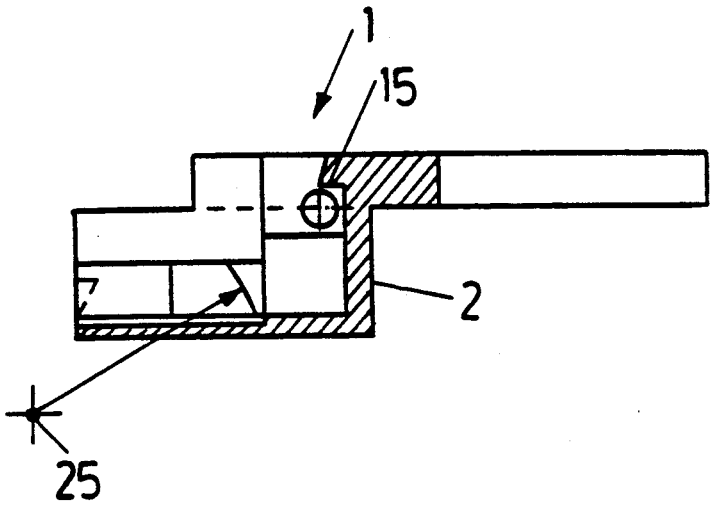
FIG. 9 is a longitudinal section through the hinge pot.

The hinge arm 20 is shown in FIG. 5. It has a leg 20′ which bears laterally against a furniture wall 27, a leg 20″ and mounting legs 24 defining a hinge axis 25 to be aligned with hinge axis 19 of coupling member 7.

On mounting the hinge, the hinge pot 1 is fit into a recess in the furniture door 26, and the hinge arm 20 is secured to the furniture side wall 27, for example screwed thereto. Mounted on the hinge arm 20 by means of the hinge axes 19, 25 is the coupling member 7 with the locking member 13, the two parts (7′, 7″) of the coupling member 7 being held together by means of the clamping screw 21. In order to mount the door 26 on the furniture side wall, all that needs to be done is to move the door 26 with the hinge pot 1 to the coupling member 7 such that the shoulders 9 may be pushed into the recesses 10. This is possible in any position of the coupling member 7, i.e. at virtually any angle of opening of the door 26. The coupling member 7 is locked in the hinge pot 1 automatically, since the locking member 13 as mentioned earlier is pressed below the nose 15 by the spring 22.

If the door 26 is to be released from the furniture side wall, i.e. the hinge pot 1 is to be separated from the coupling member 7, all that needs to be done is to pivot the unlocking member 18 away from the flange 5 as shown in FIG. 12, as a result of which the locking member 13 is pressed away from the nose 15. At the same time, the leg 22′ of the leg spring 22 presses the hinge pot 1 away from the coupling member 7, so that the hinge pot 1 is reliably prevented from being stuck thereto.

After the unlocking member 18 has been brought back into its initial position, i.e. parallel to the flange 5, the hinge arm again can be coupled at any time.

What is claimed is:

1. A hinge for mounting a door to a furniture unit to pivot relative thereto about a single axis, said hinge comprising:

a hinge pot to be mounted on the door of the furniture unit, said hinge pot having therein a recess;

a hinge arm to be mounted on a wall of the furniture unit;

a coupling member pivotally mounted on said hinge arm for pivotal movement relative thereto about said single axis;

means for enabling said coupling member to be fitted into said recess in said hinge pot, said means comprising at least one groove formed in one of said hinge pot or said coupling member and at least one shoulder formed on the other of said coupling member and said hinge pot, said shoulder being dimensioned to closely fit in said groove by being inserted therein when said hinge pot is moved relative to said coupling member in a direction substantially perpendicular to the plane of the door to be connected to said hinge pot, said groove and said shoulder each having a pair of spaced side surfaces that diverge from each other relative to a direction of insertion of said shoulder into said groove; and means for releasably locking said coupling member in an anchored position within said recess in said hinge pot, said locking means comprising a catch formed on said hinge pot, a locking member mounted on said coupling member for pivotal movement relative thereto between a locked position abutting said catch and preventing withdrawal of said shoulder from said groove and an unlocked position spaced from said catch and allowing said withdrawal, and a spring urging said locking member to pivot to said locked position thereof.

2. A hinge as claimed in claim 1, wherein said catch is formed on a wall of said hinge pot defining said recess therein.

3. A hinge as claimed in claim 1, comprising two said grooves and two said shoulder located in spaced relationship on opposite sides of said recess.

4. A hinge as claimed in claim 3, wherein said shoulders are formed on opposite side walls of said hinge pot defining said recess.

5. A hinge as claimed in claim 1, wherein said shoulder is defined in a side wall of said hinge pot defining said recess.

6. A hinge as claimed in claim 1, further comprising unlocking means, separate from said locking member, for moving said locking member against the force of said spring to said unlocked position.

7. A hinge as claimed in claim 6, wherein said unlocking means comprises an unlocking lever pivotally mounted on said hinge pot for selectively moving said locking member against the force of said spring out of abutment with said catch.

8. A hinge as claimed in claim 7, wherein said hinge pot includes a flange having therein a recess, and said unlocking lever fits within said recess of said flange in a position flush with said flange.

9. A hinge as claimed in claim 1, wherein said hinge pot has a flattened exterior end defining stop surfaces, and said coupling member has stop surfaces abutting said stop surfaces of said hinge pot.

10. A hinge as claimed in claim 1, wherein said spring is mounted in said coupling member and acts simultaneously on said locking member and said hinge pot.

11. A hinge as claimed in claim 10, wherein said spring comprises a leaf spring.

12. A hinge as claimed in claim 10, wherein said spring includes a first leg having a portion acting on said locking member and a second leg acting on said hinge pot.

13. A hinge as claimed in claim 12, wherein said second leg fits in a groove formed in a bottom of said hinge pot.

14. A hinge as claimed in claim 12, wherein said coupling member is of a two-part construction including a first part pivotally mounted on said hinge arm and a second part pivotally mounting said locking member.

15. A hinge as claimed in claim 14, wherein said portion of said first leg of said spring is clamped between said first and second parts of said coupling member.

16. A hinge as claimed in claim 1, wherein said locking member has a curved surface abutting said catch.

17. A hinge as claimed in claim 1, wherein said pair of diverging spaced side surfaces comprise a curved side surface and a planar side surface extending perpendicular to a bottom of said recess in said higher pot.

* * * * *